United States Patent [19]

Miller et al.

[11] 4,440,666

[45] Apr. 3, 1984

[54] METHOD OF MAKING CORROSION INHIBITING POLYAMINE AMIDES, THE AMIDES, AND USE THEREFOR

[75] Inventors: Richard F. Miller, Humble; Tony S. Go; George R. Wilson, III, both of Houston, all of Tex.

[73] Assignee: Atlantic Richfield Co., Los Angeles, Calif.

[21] Appl. No.: 405,821

[22] Filed: Aug. 6, 1982

[51] Int. Cl.[3] ..... C23F 11/14

[52] U.S. Cl. ..... 252/392; 252/8.55 E; 106/14.31; 106/14.42; 208/47; 422/7; 422/12

[58] Field of Search ..... 252/392, 8.55 E; 106/14.31, 14.42; 208/47; 422/7, 12

[56] References Cited

U.S. PATENT DOCUMENTS

| | | | |
|---|---|---|---|
| 2,466,517 | 4/1949 | Blair et al. | 252/392 X |
| 3,531,496 | 9/1970 | Annand et al. | 252/390 X |
| 4,168,292 | 9/1979 | Redmore et al. | 252/392 X |
| 4,392,866 | 7/1983 | Sung, et al. | 252/392 X |

*Primary Examiner*—Benjamin R. Padgett
*Assistant Examiner*—Matthew A. Thexton
*Attorney, Agent, or Firm*—C. R. Reap; D. M. Kozak; J. C. Martin, Jr.

[57] ABSTRACT

A hydrocarbonaceous liquid stream is modified to contain a minor amount of the amide reaction product of a polyalkylene polyamine, a neo-acid having 5 to 20 carbon atoms, the neo-acid having three alkyl groups on the carbon atom which is in the alpha position relative to the carboxylic group, and an aliphatic fatty acid having 10 to 30 carbon atoms, whereby corrosion of iron and other metals contacted by said stream is significantly reduced. The amides of the invention have the structural formula:

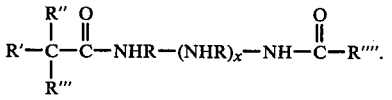

28 Claims, No Drawings

METHOD OF MAKING CORROSION INHIBITING POLYAMINE AMIDES, THE AMIDES, AND USE THEREFOR

FIELD OF INVENTION

This invention relates to the inhibition of corrosion of iron and other metals contacted by a liquid hydrocarboneous stream such as fuel oil, crude, or the like containing minor amounts of oxygen, water, acid, brine, and/or related corrosive agents.

PRIOR ART

Over the past several decades there has been a continuing demand for more effective and less expensive process corrosion inhibitors. Imidazolines, formed by the reaction of polyamines and fatty acids have been found to be acceptable for inhibiting corrosion in many chemical processes.

Blair U.S. Pat. No. 2,466,517 describes the use of imidazolines prepared from monocarboxylic acids and a diamine or a polyamine as corrosion inhibitors. Typical acids include nonoic acid, naphthenic acids, oleic acid, etc.

Hutchinson, U.S. Pat. No. 2,995,603, discloses the preparation of corrosion inhibitors from naphthenic acids which do not form cyclic amidines and alkylene polyamines.

Seffens U.S. Pat. No. 3,766,053 explains that imidazoline corrosion inhibitors prepared from napthenic acid and dipropylene triamine may be sprayed into overhead vapor lines of distillation systems to prevent corrosion by the liquid streams. This patent also discloses that polypropylene polyamines are the preferred types of polyalkylene polyamines, that napthenic acids are preferred monocarboxylic acids, and that the range of acid to polyamine should be from 1:2 to 2:1, preferably 2:1.

Various imidazoline corrosion inhibitors are described in Seffens et al U.S. Pat. No. 3,531,409.

Exxon Chemical Company's bulletin entitled "Neo Acids-Properties, Chemistry and Applications" suggests that cyclic imidazolines prepared from neo acids and polyamines may be useful for corrosion inhibition (page 10).

Among the more commonly used imidazoline corrosion inhibitors are those prepared from tall oil fatty acid. Tall oil fatty acid is a mixture of long chain fatty acids which are derived as a by-product in the manufacture of wood pulp and which have a substantial amount of unsaturated acids, particularly oleic and linoleic acids. The tall oil fatty acid imidazolines are particularly useful for oil field equipment corrosion inhibition.

Tall oil is in limited supply due to the limited amount of timber. Suitable carboxylic acids to complement or replace tall oil fatty acids as a raw material for amide-based corrosion inhibitors have been sought. There is, however, considerable variation between imidazolines prepared from other carboxylic acids. Furthermore, the step of forming an imidazoline from the amide reaction product adds to the cost of these compounds. In any event, it would be desirable to find corrosion inhibitors which are more effective than tall oil fatty acid but which can be prepared at lower cost.

SUMMARY OF THE INVENTION

It has now been discovered that certain amide compounds prepared from polyfunctional amines and a combination of a long chain fatty acid and a neo acid impart superior corrosion resistance to equipment in which petroleum or chemicals are produced or processed. These compounds differ structurally from the above-described imidazolines in that they are not cyclicized. Thus the added preparation expense of forming imidazoline structures is avoided in the present invention. This represents a considerable savings when preparing neo acid based products since the steric hindrance resulting from the presence of the three alkyl groups on the alpha carbon position makes it difficult and costly, if not impossible, to prepare imidazolines from these acids.

According to the invention amide-based corrosion inhibitors are prepared by reacting a poly(alkyleneamine) having the structure $$NH_2R—(NHR)_x—NH_2$$

wherein R is a straight or branched chain alkylene group having 2 to 6 carbon atoms and x is an integer having a value of 0 to 12, with a long chain fatty acid and a carboxylic acid having the structure

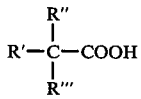

wherein R', R'' and R''' are alkyl groups and the average total sum of the carbon atoms in R', R'' and R''' usually varies from 3 to about 20 or more.

DETAILED DISCUSSION

Suitable poly(alkyleneamines) for use in the invention include straight-chain poly(alkyleneamines) such as ethylene diamine, diethylene triamine, triethylene tetramine, tetraethylene pentamine, di (tetramethylene) triamine, tri (hexamethylene) tetramine, etc.; and branched-chain poly(alkyleneamines) such as 1-methyl-1,2-diaminoethane, bis (3-amino-2-methylpropylamine, etc.). The methods of manufacture of suitable poly(alkyleneamines) are well known and they are commercially available. Their preparation forms no part of the present invention.

The neo acids used in the invention are commercially available from Exxon Chemical Company under the name Neo Acids or from Shell Chemical Company under the name Versatic Acids ® or they may be prepared by well known methods such as described in Feffer describes amides prepared from neo acids in an article "Neoacids" J. Am. Oil Chemists Soc., 55 342A (1978). The method of preparation of the neo acids is well known and forms no part of this invention.

The neo acid may be a pure acid or it may be a mixture of acids, such as the bottoms residue obtained after the purification step of a neo acids manufacturing process. The broad molecular weight mixtures of neo acids obtained as the distillation bottoms residue from the manufacture of neo acids is particularly suitable for use as the neo acid component of the present invention. The total number of carbon atoms in the alkyl radicals attached to the alpha carbon atom of these acid mixtures may range as high as 25 or more. The average of the total number of carbon atoms in the alpha alkyl radicals is desirably in the range of 3 to about 20 carbon atoms. When the neo acid is trimethyl acetic acid the sum of R', R'', and R''' will, of course, be 3.

Typical neo acids that fall within the above description include neopentanoic acid, mixed neodecanoic acids, 2,2-dimethyl heptadecanoic acid, triethyl acetic acid, dimethyl pentyl acetic acid, etc.

Long chain fatty acids which are usable in the invention include alphatic acids having about 10 to 30 carbon atoms. In preferred embodiments the alphatic fatty acid has a carbon content of 12 to 20 and most preferably about 16 to 18 carbon atoms per molecule. The fatty acid may be saturated or ethylenically unsaturated and may be linear or branch-chained. The preferred aliphatic fatty acids are the unsaturated fatty acids. As can be appreciated mixtures of two or more fatty acids can be used in the invention.

Examples of suitable fatty acids include saturated fatty acids, such as capric acid, lauric acid, myristic acid, palmitic acid, stearic acid, arachidic acid, lignoceric acid, 2-methyl pentadecanoic acid, 2-ethyl palmitic acid, etc. and unsaturated fatty acids such as oleic acid, linoleic acid, palmitoleic acid, petroselenic acid, ericic acid, etc. Preferred acids include stearic acid, oleic acid and linoleic acid. Commercially available hydrolyzed fats and oils contain mixtures of the above fatty acids and these may be conveniently used in the invention. Examples of such fat acids include tall oil fatty acid, palm oil fatty acid, peanut oil fatty acid and cotton seed oil fatty acid. Mixtures of the above fatty acids and fat acids may be used in the invention.

The amides of the invention are prepared by reacting the tall oil fatty acid and the desired neo acid or mixture of neo acids with the desired polyfunctional amine in accordance with the following equation:

$$NH_2R(NHR)_xRNH_2 + R'-\overset{R''}{\underset{R'''}{C}}COOH + R''''COOH \rightleftharpoons (R'R''R''')C\overset{O}{\overset{\|}{C}}-NHR-(NHR)_xRNH-\overset{O}{\overset{\|}{C}}-R'''' + 2H_2O$$

wherein R, R', R'' and R''' are as described above and R'''' is a straight or branched chain, saturated or ethylenically unsaturated aliphatic radical having 9 to 29 and preferably 11 to 19 carbon atoms forming a part of the long chain fatty acids described above. The reaction is accomplished by contacting the amine with excess acid while maintaining the mixture at an elevated temperature eg. about 50° to 250° C. for a sufficient period of time to form the diamine and remove the water of reaction. During the reaction the pressure is generally maintained in the range of about 0.5 to 150 psia, although pressure is not a critical limitation. Usually autogeneous pressure is maintained. As indicated in the above equation two moles of water are formed for each molecule of diamide formed. The reaction is preferably carried out in a closed container at a temperature high enough to distill off the water of reaction. The reaction is terminated when approximately two moles of water are received for each mole of amine (or for each two moles of carboxylic acid) charged to the reactor. In preparing the product some monoamide, tri- or higher amide, and some molecules in which both amide groups formed from the neo acid or from the long chain fatty acid will undoubtedly be formed but the predominant product will be the mixed diamide shown in the equation above. The amount of monoamide formed is minimized by carefully controlling the relative amounts of reactants and carrying out the reaction sufficiently long to avoid the formation of undesirably high amounts of monoamide. Since the internal secondary amine groups of the polyfunctional amines are less reactive than the terminal primary amine groups very few amide groups involving the secondary amine groups will be formed under the prescribed reaction conditions.

A typical procedure for preparing the desired diamide is as follows. The desired long chain fatty acid or mixture of long chain fatty acid and the desired neo acid or mixture of neo acids are blended with a suitable solvent, preferably an aromatic solvent such as xylene, toluene, etc., in a closed reaction vessel equipped with means for collecting and measuring the volume of water of reaction distilled over from the reaction vessel. The mixture is heated to about 80° to 140° C. and the polyfunctional amine component is slowly introduced into the reactor. The amine addition is continued until about ½ mole of amine is added for each mole of acid in the reactor. The temperature is gradually permitted to increase, with external heating, if necessary, until the theoretical amount of water removal necessary to produce the desired diamide is accomplished. During the reaction, which is exothermic and requires about three hours for completion, the reaction mixture is continuously stirred to ensure the maintenance of a uniform temperature throughout the reaction mixture. The reaction product is then cooled and, if desired, diluted with a suitable organic solvent, such as kerosene, naphta or an aromatic solvent.

The order of reaction of the polyfunctional amine with the long chain fatty acid and the neo acid is not critical as long as a product containing a substantial percentage of molecules which have both a long chain fatty acid amide group and a neo acid amide group are obtained. Thus, the amine may be reacted with the long chain fatty acid or the neo acid at first and then with a combination of the acids. Conversely, the amine may be first added to a mixture of the long chain fatty acid and the neo acid and additional long chain fatty acid or neo acid may be added subsequently to complete the reaction.

The corrosion inhibitor composition of the invention may include other additives, if desired. For example, other corrosion inhibitors may be used in combination with the corrosion inhibitors of this invention or long chain fatty acids may be combined with the inhibitor compositions to improve the solubility of these compositions in petroleum and petroleum derivatives.

The corrosion inhibitor composition of the invention can be introduced into the equipment to be protected by any conventional method. It is generally introduced just upstream of the point of desired application by any suitable means, such as by use of a proportionating pump. The corrosion inhibitor may be added as a concentrate but it is preferable to add it as a solution in a liquid diluent which is compatible with the stream being handled or treated. The inhibitor is used at the concentration which is effective to provide the desired protection against corrosion. It has been determined that amounts of corrosion inhibitor in the range of about 0.05 to 1000 ppm based on the weight of the petroleum or petroleum derivative stream being treated afford ample protection against corrosion. For most applications the inhibitor is used in amounts in the range of about 0.1 to 100 ppm.

The following examples will serve to further illustrate the invention. Unless otherwise stated, parts and percentages are on a weight basis.

EXAMPLE I to a three-neck flask equipped with an agitator, a condensor and a graduated receiver for measuring the volume of water distilled over with the xylene entraining agent is charged 58.41 grams of xylene and 195.69 grams (0.75 mole) of neodecanoic acid bottoms (0.75 mole) having an acid number of approximately 215 and 221.44 grams of tall oil fatty acid sold by Arizona Chemical Company under the trademark Acintol® FA-1. The reaction mixture is then heated to 90° C. with agitation and 109.68 grams (0.75 mole) of triethylenetetramine is slowly added. The temperature is then raised to 160° C. and maintained at that temperature for 3 hours. After this time, the reaction is further heated to 215° C. to drive the reaction to completion while removing the by-product of reaction, water, via distillation. The reaction mixture is then cooled. The formation of the diamide is evident by an absorption at 1640 $cm^{-1}$ in the infrared spectrum.

EXAMPLE II

To a three-neck flask equipped with an agitator, a condensor and a graduated receiver for measuring the volume of water distilled over with the xylene entraining agent is charged 58.41 grams of xylene and 391.38 grams (1.5 moles) of neodecanoic acid having an acid number of approximately 215. The reaction mixture is then heated to 90° C. with agitation and 77.25 grams (0.75 moles) of diethylenetriamine is slowly added. The temprature is then raised to 160° C. and maintained at that temperature for 3 hours. After this time, the reaction is further heated to between 180° and 215° C. to drive the reaction to completion while removing the by-product of reaction, water, via distillation. Upon recovery of 27 mls of water (1.5 moles) the reaction is considered to be complete and is cooled. The formation of the diamide is evident by an absorption at 1640 $cm^{-1}$ in the infrared spectrum.

EXAMPLE III

To a three-neck reaction flask equipped with an agitator, a condenser, a graduated receiver for measuring the volume of water, distilled over with the xylene entraining agent is charged 15.03 grams of xylene and 204.63 grams (0.700 moles) of Acintol® FA-1. The reaction mixture is then heated to 90° C. with agitation and 80.34 grams of diethylene triamine (0.78 moles) is slowly added. The temperature is then raised to between 210° C. and 215° C. and maintained for 7.5 hours, while removing the by-product of reaction, water, via distillation. After this time, the reaction is further heated to between 215° C. and 240° C. for approximately one-half hour to ensure maximum reaction yield and to remove excess diethylene triamine from the reaction product. The formation of an amide/imidazoline mixture is evident by two absorption peaks at approximately 1610 and 1640 $cm^{-1}$ in the infrared spectrum.

EXAMPLE IV

An extreme corrosion test is employed to rate the effectiveness of several corrosion inhibiting compositions. This test is a modified version of an oilfield test for sour corrosion, sour corrosion being defined as corrosion occuring in the presence of acidic gases such as $H_2S$ or $CO_2$. Each test is conducted in triplicate. Runs 1 to 3 contain no corrosion inhibitor; Runs 4 to 6 contain the corrosion inhibitor prepared in Example I; Runs 7 to 9 contain the corrosion inhibitor prepared in Example II; and Runs 10 to 12 contain the corrosion inhibitor prepared in Example III. The test procedure is as follows: To a 150 ml pressure bottle is placed a 0.005 inch mild steel shimstock coupon. Also to the bottle is also added 50 ml of kerosene test solution and 50 ml of 0.01 N HCl. Hydrogen sulfide ($H_2S$) gas is then bubbled through the resultant solution to assure a $H_2S$ rich atmosphere. The samples are then agitated for 24 hours at 180° F. After 24 hours, the coupons are washed in hexane, dried and weighed. The results are reported in Table I. The percentage protection tabulation in Table I is determined by the following equation. The "wt loss(blank)" is the average weight loss measured in Runs 1 to 3.

TABLE I $$\% \text{ protection} = \frac{\text{wt loss (blank)} - \text{wt. loss (treated coupon)}}{\text{wt. loss (blank)}} \times 100$$

| RUN NUMBER | CORROSION INHIBITOR | TREATMENT (ppm) | COUPON WEIGHT LOSS (mg) | AVERAGE % PROTECTION |
|---|---|---|---|---|
| 1 | blank | 0 | 38.8 | |
| 2 | blank | 0 | 32.5 | 0 |
| 3 | blank | 0 | 36.9 | 0 |
| | | | Average = 36.06 | |
| 4 | Product of Example I | 5 | 22.8 | |
| 5 | Product of Example I | 5 | 22.8 | 32.89 |
| 6 | Product of Example I | 5 | 27.2 | |
| | | | Average = 24.2 | |
| 7 | Product of Example II | 5 | 31.12 | |
| 8 | Product of Example II | 5 | 28.7 | 20.78 |
| 9 | Product of Example II | 5 | 25.8 | |
| | | | Average = 28.56 | |
| 10 | Product of Example III | 5 | 27.8 | |
| 11 | Product of Example III | 5 | 28.3 | 18.37 |
| 12 | Product of Example III | 5 | 32.2 | |
| | | | Average = 29.43 | |

Example IV shows the effectiveness of the corrosion inhibitor of the invention compared to conventional imidazoline corrosion inhibitors. The corrosion inhibitor used in Runs 4–6 is the diamide of Example I. Note that the percentage protection obtained with this corrosion inhibitor is superior to the corrosion inhibitor of Runs 7–9 and the conventional corrosion inhibitor used in Runs 10–12.

EXAMPLE V

To demonstrate the broad application range of the disclosed compositions, their solubility in propane is determined as follows. One-half gram of material is introduced into a heavy-walled tube with pressure fittings. A small stirring bar is placed into the tube and the tube sealed, placed on a stirring plate and attached to an inverted propane cylinder. Approximately 1 inch of liquified propane is introduced into the tube, stirring is started and the solubility of the corrosion inhibitor determined according to the scale shown. The pressure is then slowly released. The results are shown in Table II.

TABLE II

| PROPANE SOLUBILITY TEST RESULTS | | |
|---|---|---|
| TEST NUMBER | CORROSION INHIBITOR | VISUAL OBSERVATION OF SOLUBILITY(1) |
| 1 | Product of Example I | Soluble |
| 2 | Product of Example II | Soluble |
| 3 | Product of Example III | Insoluble |

(1)Soluble — solution is clear
Insoluble — solution has two layers

The importance of the propane solubility test is to ensure that the corrosion inhibitor is soluble in light hydrocarbon fractions thereby ensuring uniform distribution throughout the system to be protected. Insolubility in light hydrocarbon fractions indicates that the lower limit protection may not be uniform in systems containing liquified petroleum-derived gases. As is indicated in Table II the product of Example I is soluble whereas the product of Example III, representing prior art, are insoluble.

Although the invention has been described with particular reference to specific examples, it is understood that the invention is not limited thereto. The scope of the invention is determined by the breadth of the appended claims.

The invention claimed is:

1. A corrosion inhibitor for hydrocarbonaceous liquid processing systems comprised of an amide having the structural formula:

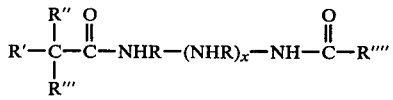

wherein R is a straight or branched chain alkylene group having 2 to 6 carbon atoms; x is an integer of 0 to 12; R′, R″ and R‴ are the same or different alkyl groups and the average sum of the carbon atoms in R′, R″ and R‴ varies from 3 to 20, and R⁗ is an aliphatic hydrocarbon radical having 9 to 29 carbon atoms.

2. The corrosion inhibitor of claim 1 wherein R is ethylene, propylene or butylene and x is 0, 1 or 2.

3. The corrosion inhibitor of claims 1 or 2 wherein the average sum of the carbon atoms in R′, R″ and R‴ is 3 to 18.

4. The corrosion inhibitor of claims 1 or 2 wherein R′, R″ and R‴ are methyl radicals.

5. The corrosion inhibitor of claims 1 or 2 wherein the sum of the carbon atoms in R′, R″ and R‴ is 8.

6. The corrosion inhibitor of claims 1 or 2 wherein the sum of the carbon atom in R′, R″ and R‴ is 18.

7. The corrosion inhibitor of claim 3 wherein R⁗ has 11 to 19 carbon atoms.

8. The corrosion inhibitor of claim 4 wherein R⁗ has 11 to 19 carbon atoms.

9. The corrosion inhibitor of claim 5 wherein R⁗ has 11 to 19 carbon atoms.

10. The corrosion inhibitor of claim 6 wherein R⁗ has 11 to 19 carbon atoms.

11. The corrosion inhibitor of claim 7 wherein R⁗ is an ethylenically unsaturated aliphatic radical having 13 to 17 carbon atoms.

12. The corrosion inhibitor of claim 8 wherein R⁗ is an ethylenically unsaturated aliphatic radical having 13 to 17 carbon atoms.

13. The corrosion inhibitor of claim 9 wherein R⁗ is an ethylenically unsaturated aliphatic radical having 13 to 17 carbon atoms.

14. The corrosion inhibitor of claim 10 wherein R⁗ is an ethylenically unsaturated aliphatic radical having 13 to 17 carbon atoms.

15. The corrosion inhibitor of claim 3 wherein the

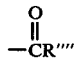

radical is derived substantially from oleic acid, linoleic acid or mixtures of these.

16. In a method of inhibiting metal corrosion in hydrocarbonaceous liquid processing equipment by the introduction of amide-based corrosion inhibiting compositions into the equipment, the improvement comprising using a corrosion inhibiting composition containing as the principal component a compound having the structural formula:

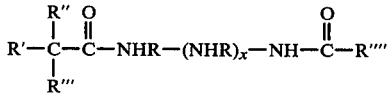

wherein x is an integer having a value of 0 to 12, R is a straight or branched chain alkylene group having 2 to 6 carbon atoms, R′ R″ and R‴ are alkyl groups and the average sum of the carbon atoms contained in R′ R″ and R‴ varies from 3 to 20 and R⁗ is an aliphatic hydrocarbon radical having 9 to 29 carbon atoms.

17. The method of claim 16 wherein R is the ethylene, propylene or butylene radical and x is an integer having a value of 0, 1 or 2.

18. The method of claims 16 or 17 wherein the average sum of the carbon atoms in R′, R″ and R‴ is 3 to 18.

19. The method of claims 16 or 17 wherein R′, R″ and R‴ are methyl radicals.

20. The method of claims 16 or 17 wherein the sum of the carbon atoms in R′, R″ and R‴ is 8.

21. The method of claims 16 or 17 wherein the sum of the carbon atoms in R′, R″ and R‴ is 18.

22. The method of claim 18 wherein R⁗ is an aliphatic hydrocarbon radical having 11 to 19 carbon atoms.

23. The method of claim 22 wherein R⁗ is an ethylenically unsaturated aliphatic hydrocarbon radical having 13 to 17 carbon atoms.

24. The method of claim 23 wherein the

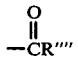

radical is derived substantially from oleic acid, linoleic acid and mixtures of these.

25. A process for preparing a corrosion inhibitor composition comprising reacting, at a temperature of about 50° to 250° C., (a) a polyamine having the structural formula $$NH_2(NHR)_x—NH_2$$

wherein R is a straight or branched chain alkylene group having 2 to 6 carbon atoms and x is an integer having a value of 0 to 12, (b) a carboxylic acid having the structural formula

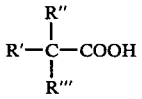

wherein R′, R″ and R‴ are alkyl groups and the average total sum of the carbon atoms in R′, R″ and R‴ is 3 to 20, and (c) an aliphatic fatty acid having 10 to 30 carbon atoms.

26. The process of claim 25 wherein R is ethylene, propylene or butylene; x is 0, 1 or 2; the average total sum of carbon atoms in R′, R″ and R‴ is 3 to 18; and said aliphatic fatty acid has 12 to 20 carbon atoms.

27. The process of claim 26 wherein the aliphatic fatty acid is ethylenically unsaturated and contains 14 to 18 carbon atoms.

28. The process of claim 27 wherein the aliphatic fatty acid is tall oil fatty acid.

* * * * *